US006189734B1

(12) United States Patent
Apps et al.

(10) Patent No.: US 6,189,734 B1
(45) Date of Patent: Feb. 20, 2001

(54) MERCHANDISE DISPENSING DEVICE

(75) Inventors: William P. Apps, Alpharetta; Frank Becker, Buford; Philip C. Hwang, Duluth, all of GA (US); Jerry Koefelda, Hermosa Beach, CA (US)

(73) Assignee: Rehrig Pacific Company, Los Angeles, CA (US)

( * ) Notice: Under 35 U.S.C. 154(b), the term of this patent shall be extended for 0 days.

(21) Appl. No.: 08/923,267

(22) Filed: Sep. 4, 1997

Related U.S. Application Data

(60) Provisional application No. 60/031,118, filed on Nov. 18, 1996.

(51) Int. Cl.[7] ..... A47B 73/00

(52) U.S. Cl. ..... 221/193; 221/191; 221/165; 221/308; 211/74; 211/59.2

(58) Field of Search ..... 221/298, 289, 221/308, 310, 165, 193, 191, 82, 86; 211/59.2, 74

(56) References Cited

U.S. PATENT DOCUMENTS

| | | | | |
|---|---|---|---|---|
| 2,218,444 | * | 10/1940 | Vineyard | 211/49 |
| 2,289,751 | * | 7/1942 | Brenholt | 211/49 |
| 2,588,618 | | 3/1952 | Di Renzo | 312/49 |
| 2,620,691 | | 12/1952 | Gould . | |
| 2,880,904 | | 4/1959 | Linthicum | 221/125 |
| 2,943,900 | | 7/1960 | Van Brunt . | |
| 3,243,220 | | 3/1966 | Karas . | |
| 3,553,927 | | 1/1971 | Anglade, Jr. | 53/26 |
| 4,037,766 | | 7/1977 | Iacono | 224/45 AA |
| 4,303,162 | | 12/1981 | Suttles . | |
| 4,310,097 | | 1/1982 | Merl | 211/49 D |
| 4,318,485 | * | 3/1982 | Clement | 211/74 X |
| 4,367,818 | | 1/1983 | Suttles | 211/49 D |
| 4,401,221 | | 8/1983 | Suttles | 211/74 |
| 4,423,816 | | 1/1984 | Suttles | 211/183 |
| 4,598,828 | | 7/1986 | Young et al. . | |
| 4,809,855 | | 3/1989 | Bustos . | |
| 5,586,665 | | 12/1996 | Brousseau . | |
| 5,586,687 | | 12/1996 | Spamer et al. | 221/298 |
| 5,595,310 | | 1/1997 | Spamer et al. | 211/59.2 |
| 5,645,176 | * | 7/1997 | Jay | 211/59.2 |
| 5,669,527 | | 9/1997 | Hardy . | |
| 5,695,074 | * | 12/1997 | Wiese | 211/59.2 |
| 5,695,075 | | 12/1997 | Flum et al. . | |
| 5,706,956 | * | 1/1998 | Headrick et al. | 211/59.2 |
| 5,706,958 | | 1/1998 | Spamer . | |
| 5,706,978 | | 1/1998 | Spamer et al. . | |
| 5,718,341 | * | 2/1998 | Robertson | 211/59.2 |
| 5,755,341 | | 5/1998 | Spamer . | |
| 5,779,068 | | 7/1998 | Whiten et al. . | |
| 5,788,091 | | 8/1998 | Robertson et al. . | |
| 5,845,791 | | 12/1998 | Kawolics . | |
| 5,865,324 | | 2/1999 | Jay et al. . | |
| 5,875,919 | | 3/1999 | Spamer et al. . | |
| 5,878,862 | | 3/1999 | Dewsnap . | |
| 5,878,894 | | 3/1999 | Robertson . | |
| 5,904,256 | | 5/1999 | Jay . | |

FOREIGN PATENT DOCUMENTS

| | | |
|---|---|---|
| 0 032 122 A2 | 7/1981 | (EP) . |

* cited by examiner

*Primary Examiner*—Christoher P. Ellis
*Assistant Examiner*—Patrick Mackey
(74) *Attorney, Agent, or Firm*—Brooks & Kushman P.C.

(57) ABSTRACT

A gravity feed merchandise dispensing device comprises at least one plastic track capable of supporting in tandem a row of similar bottles of the type having an annular neck flange, and has a lead bottle support basket suspended at the front end of the track which is removable and interchangeable with other lead bottle supports so as to accommodate bottles of different heights. The rails of the track have a sloped transition section at the front end of the track which eases movement of bottles off the track and into the basket, and facilitates the front loading of bottles into the track.

39 Claims, 8 Drawing Sheets

MERCHANDISE DISPENSING DEVICE

This application claims the benefit of provisional application No. 60/031,118, filed Nov. 18, 1996.

TECHNICAL FIELD

The present invention relates to a merchandising display unit for bottles, and in particular, a merchandising display unit having interchangeable bottle dispensing components which accommodate bottles of different heights.

BACKGROUND OF THE INVENTION

Refrigerated display cases for beverage containers, and the like, generally include vertically aligned rows of racks, commonly called glide racks, upon which the beverage containers are loaded. The beverage containers may be cans or bottles of any size and the width of the glide rack rows are adjusted accordingly to accommodate each particular container. The glide rack includes a plurality of rows extending from the front of the glide rack to the rear thereof. Each row may then be loaded with rows of beverage containers extending from the front of the display case to the rear of the display case. Each glide rack is disposed within the refrigerated display case at an angle of approximately five to twelve degrees. Thus, when the lead beverage container is removed from the row by a customer, the next beverage container will move forward to occupy the forwardmost position, and the remainder of the row of beverage containers will follow. In this manner, there is always a beverage container at the front of each row of the glide rack ready to be dispensed to a customer.

The smooth sliding surface of the glide rack soon wears off, however, thus creating more friction as the beverage containers slide thereon such the plastic sliding surface of the glide rack becomes more roughened. This in turn creates more problems as the beverage containers may fall over, tip, rotate, occasionally open and spill. The repeated sliding along the roughened sliding surface and the beverage containers tipping and spilling creates a worn and unusable glide rack within only three to four months of use. Therefore, it has generally been necessary to completely replace the entire glide rack once it reached this point of wear and tear, resulting in costly and repeated expenditures.

To avoid the drawbacks of conventional glide racks, another alternative for merchandising bottles for display and purchase is an overhead support system, such as shown in U.S. Pat. No. 4,401,221 to Suttles and U.S. Pat. No. 4,318,485 to Clement. In these types of systems, an overhead support track having a pair of rails is used to receive the neck flange of the bottle to be displayed. The bottles are inserted from the rear and slide forward under gravity feed due to the angle of the support track.

In some of these prior art configurations, the front end of the track is sloped upwardly so as to retard the forward motion of the bottles and to present the lead bottle to the customer. As a result, the bottom of the lead bottle is kicked out in a forward direction due to the force from the bottles therebehind, thereby presenting an unorganized merchandising display of the bottles. In addition, these types prior art systems require the customer to grasp the bottle by the bottom area and pull upwards in order to remove the bottle neck from the prior art track that holds it. This makes it more difficult for the customer to remove a bottle from the display. Further, should the customer change his mind about his beverage selection, it is extremely difficult to reinsert the bottle into the track from the front thereof.

In another prior art configuration, a fixed stirrup-like structure at the forward end of the track catches and supports the lead bottle, which no longer is supported by the track. This system cannot readily accommodate bottles of different heights. Further, due to the assembly of the display units of the prior art, should a single track need to be replaced, it is necessary to disassemble an entire shelf in order to do so.

SUMMARY OF THE INVENTION

The present invention provides a merchandising display system for bottles that is quickly and easily installed. The system of the present invention also provides easily interchangeable components tailored to bottles of different height and/or diameter, thus yielding greater flexibility for the use of the system. In addition, the system of the present invention offers increased visibility of the bottled product to be displayed for sale, both the bottle label and any distinctive shaping of the bottle itself, and enables the product to be loaded from either the front or the rear.

These and other objects are achieved by providing a gravity feed merchandise dispensing device of the type comprising at least one track, each track capable of supporting in tandem a row of similar bottles of the type having an annular flange on the neck of the bottle, and each track having a front end, a rear end and a pair of rails spaced apart to receive between them the necks of suitably sized bottles such that the underside of each bottle neck flange engages the rails whereby the bottles are suspended by their flanges for movement relative to the track. A lead bottle support is suspended from the track and sized to support the bottom of the lead bottle of the row with the neck of the lead bottle adjacent the front end of the track but disengaged from the rails. Each track normally is inclined downwardly toward the front end so as to permit the suspended bottles to gravity-feed one after the other to the front end of the track each time the lead bottle in the row is unloaded from the lead bottle support. The lead bottle support is removably suspended on the track and is interchangeable with other lead bottle supports, some of different height and/or diameter.

Preferably, the front end of each of the rails slants downwardly relative to the rail to form a transition ramp for bottle neck flanges as the bottles move from the track to the lead bottle support during dispensing, or as the bottles move from the lead bottle support to the track when the track is being loaded from the front.

Various additional advantages and features of novelty which characterize the invention are further pointed out in the claims that follow. However, for a better understanding of the invention and its advantages, reference should be made to the accompanying drawings and descriptive matter which illustrate and describe a preferred embodiment of the invention.

DETAILED DESCRIPTION

Figure 1:
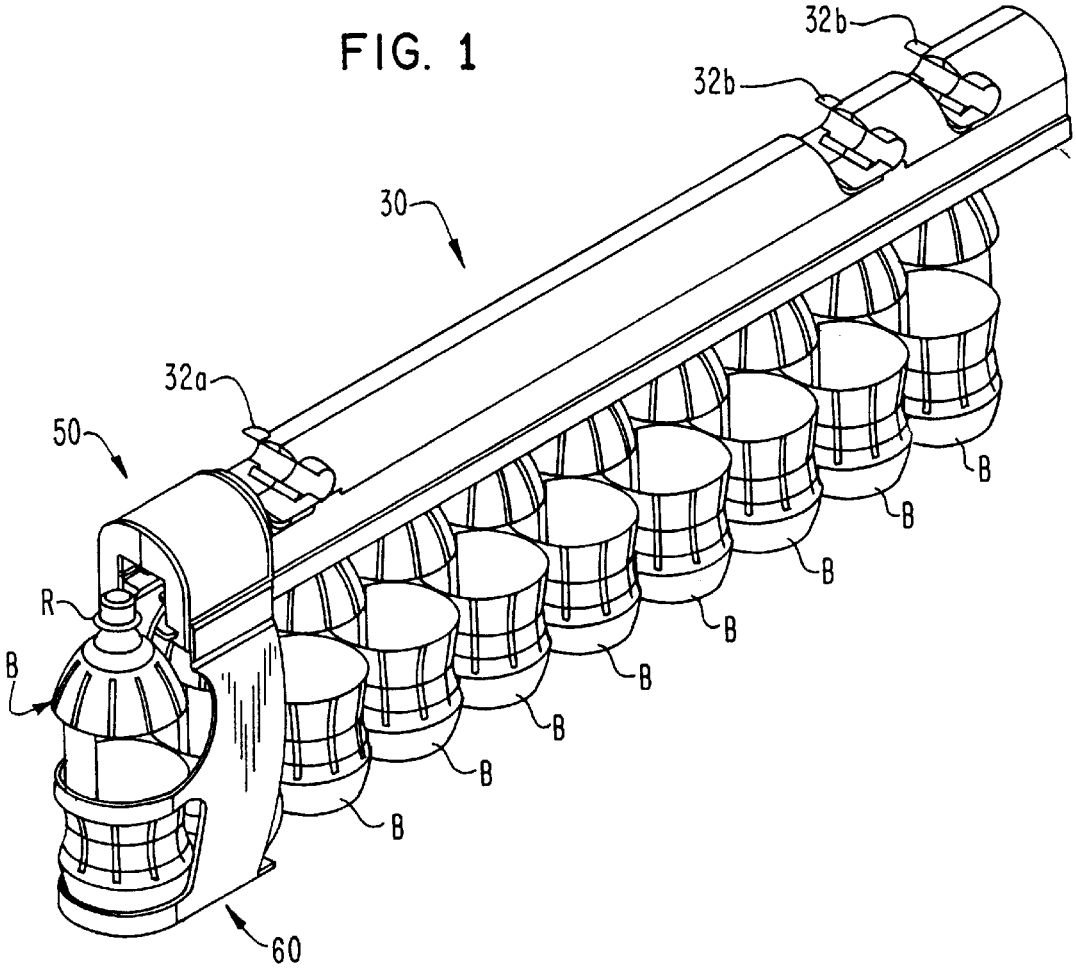
FIG. 1 is a perspective view of a single dispensing track according to the present invention, showing the bottles in position on the track, with the lead bottle in a dispensing basket.
Figure 2:
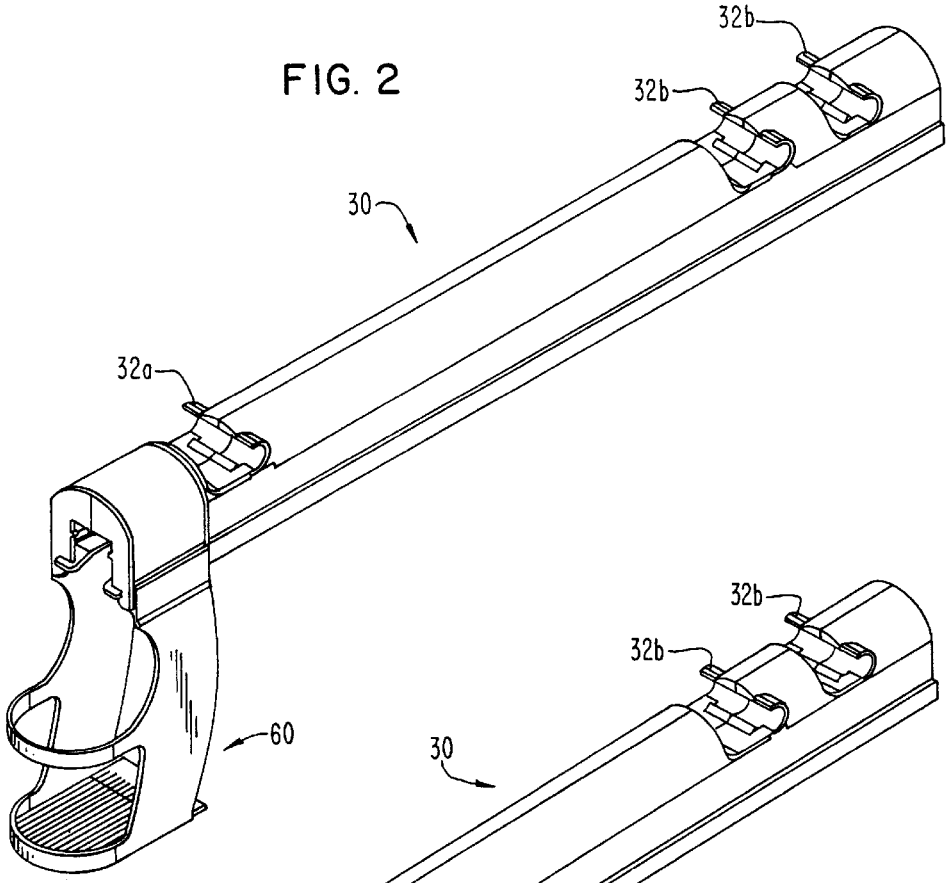
FIG. 2 is a perspective view similar to FIG. 1, but showing the track and basket empty.

A merchandising display unit in accordance with the present invention may be used within a refrigerated display case in lieu of the prior art glide rack units, or anywhere else the merchandiser may be inclined to display the bottles for sale.

Referring to FIGS. 1–5, the display unit includes a plurality of posts 10 with crossbars 20 extending between adjacent front posts 10*a* and between adjacent rear posts 10*b*, and a plurality of tracks or lanes 30 being mounted on the crossbars 20 by means of integral snap hooks 32*a*, 32*b*, with a lead bottle support or dispensing basket 60 suspended on the front end of each track 30.

Figure 4:
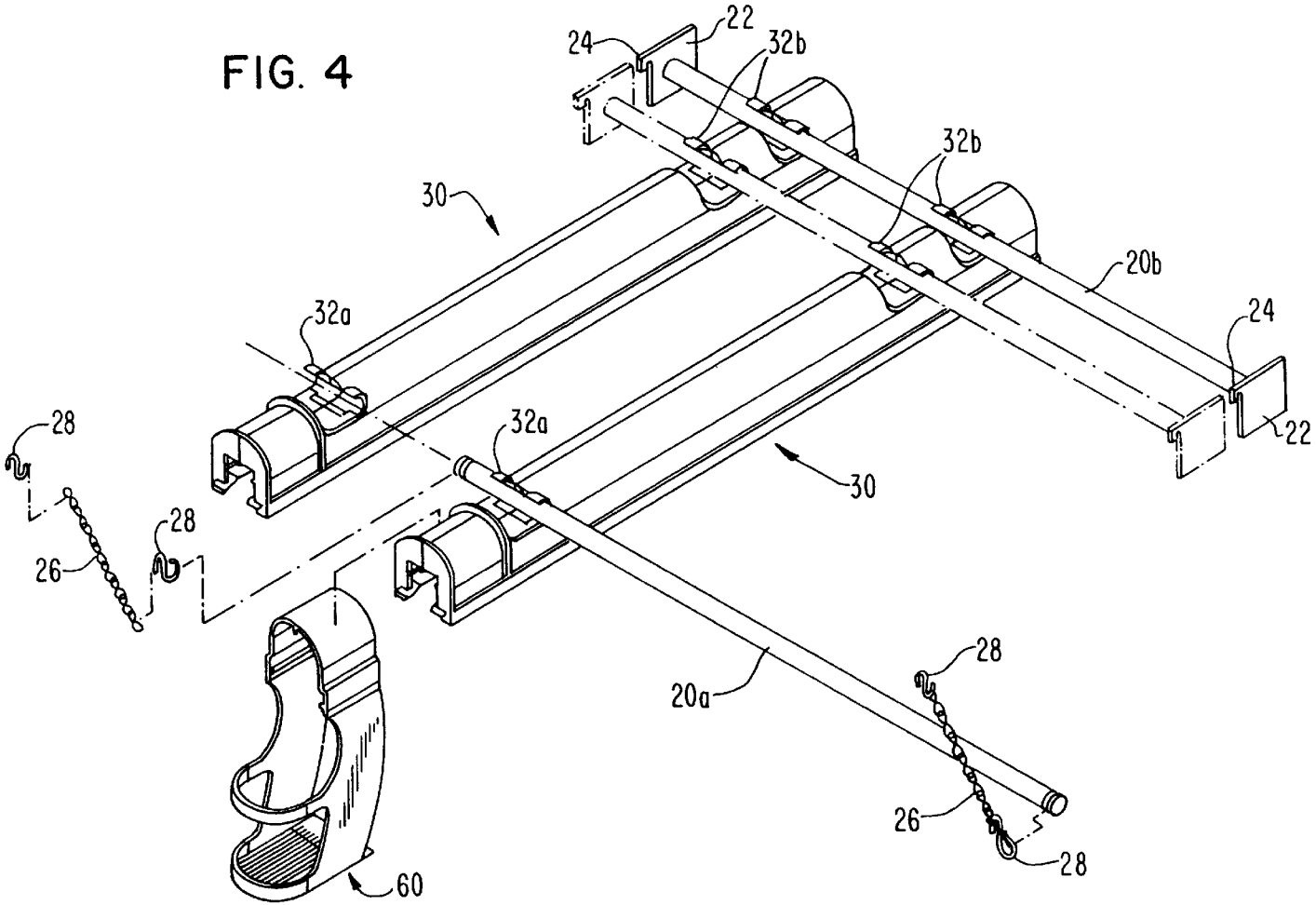
FIG. 4 is an exploded view showing the assembly of two tracks and the crossbar supports to which they are attached.
Figure 5:
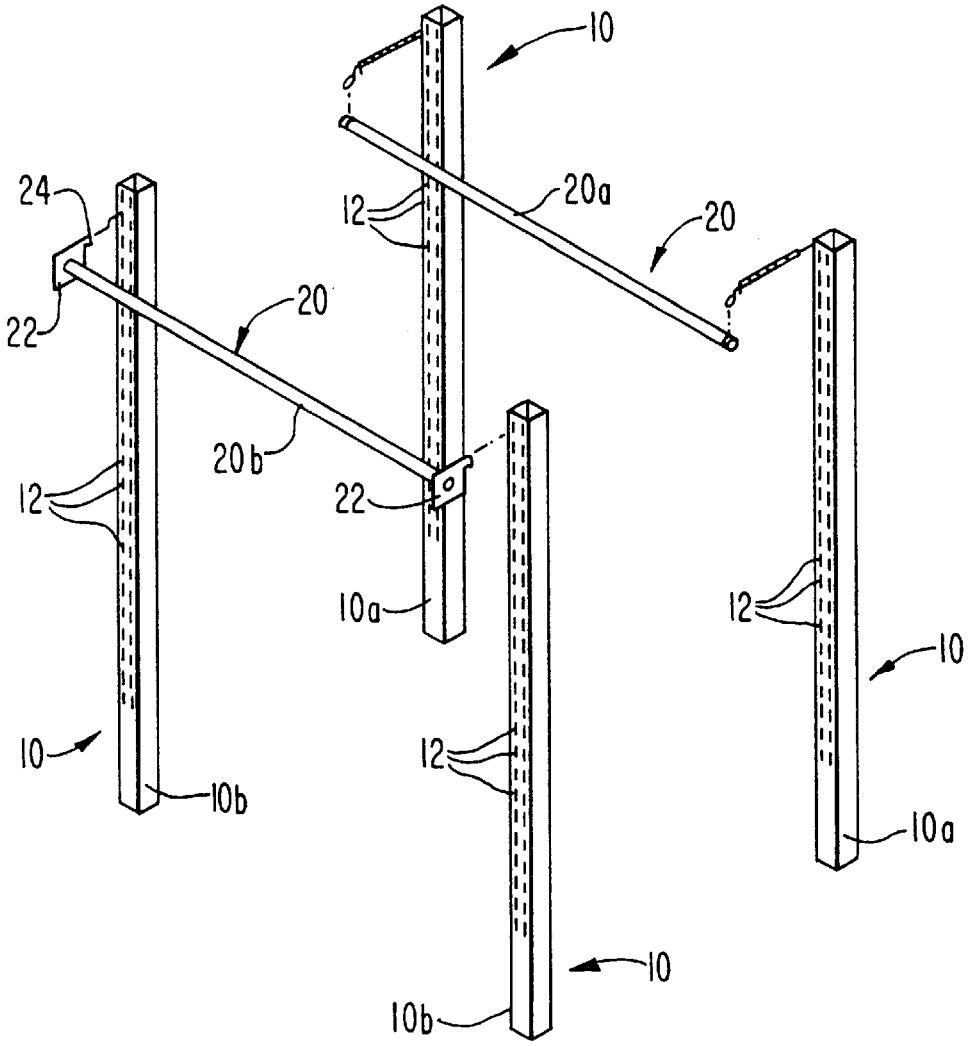
FIG. 5 is a rear perspective view of the support posts and crossbars for the merchandising display unit on which the dispensing tracks of the invention are mounted.

Referring to FIGS. 4 and 5, rear crossbar 20*b* includes endplates 22 having securing hooks 24 extending from the ends thereof Each of posts 10*a*, 10*b* has a series of vertically spaced slots or holes 12 on the rear face thereof. Thus, as in a conventional shelving arrangement, securing hooks 24 are disposed in holes 12 and a downward force is used to secure the crossbars in place by engagement of securing hooks 24 with the edges of the holes. A similar attachment can be used for front crossbar 20*a*, but chains 26 and S-hooks 28 are preferred because they more easily accommodate variations in post spacing.

After the crossbars 20*a*, 20*b* are installed, tracks 30 are mounted thereon by securing snap hooks 32*a*, 32*b* onto the crossbars. As shown in FIG. 4, one of the two rearmost snap hooks 32*b* is disposed over the rear crossbar 20*b* while the forwardmost snap hook 32*a* is disposed over the front crossbar 20*a*. The rear crossbar 20*b* is mounted slightly higher than the front crossbar 20*a* such that track 30 is slightly inclined at a preferred angle of approximately seven to eleven degrees. The inclined slope of the track assists in providing a gravity feed for the bottles B when they are loaded therein and thereby assists in maintaining the lead bottle in the proper position for presentation to the customer.

Crossbars 20*a*, 20*b* have a preferred diameter of 0.75 inches and a preferred length of approximately 29.6 inches, but can be of two-part, telescopic construction so as to be adjustable. Endplates 22 have a preferred thickness of approximately 0.25 inches, a width and length of approximately 2.25 inches, and are welded or otherwise secured to the ends of crossbars 20. Securing hook 24 extends approximately 0.5 inches from end plate 22 and is approximately 0.5 inches wide. Posts 10 are supported in conventional fashion, e.g., on adjustable leveling feet (not shown), and are fixed in relative positions by conventional top and bottom bracing (not shown). The crossbars 20, end plates 22 and posts 10 preferably are made of steel and are painted or otherwise coated to inhibit corrosion.

Track 30 in accordance with a preferred embodiment of the present invention is shown in greater detail in FIGS. 3, 8, 9 and 10. In a preferred embodiment, track 30 is injection molded of high impact polystyrene in left and right halves 30*a*, 30*b*, which are welded together ultrasonically to form a unitary structure. A rear bottle stop 34 in the form of a wire loop is inserted into recesses in the track halves prior to welding. Reinforcing ribs 36 are integrally molded into each track half 30*a*, 30*b*. Track 30 has a length of approximately 29.5 inches and a width of approximately 2.770 inches, although it will be obvious to one skilled in the art that any desired width and length could be used depending upon the size of the bottles to be supported and the overall size of the entire merchandising display unit.

Figure 8:
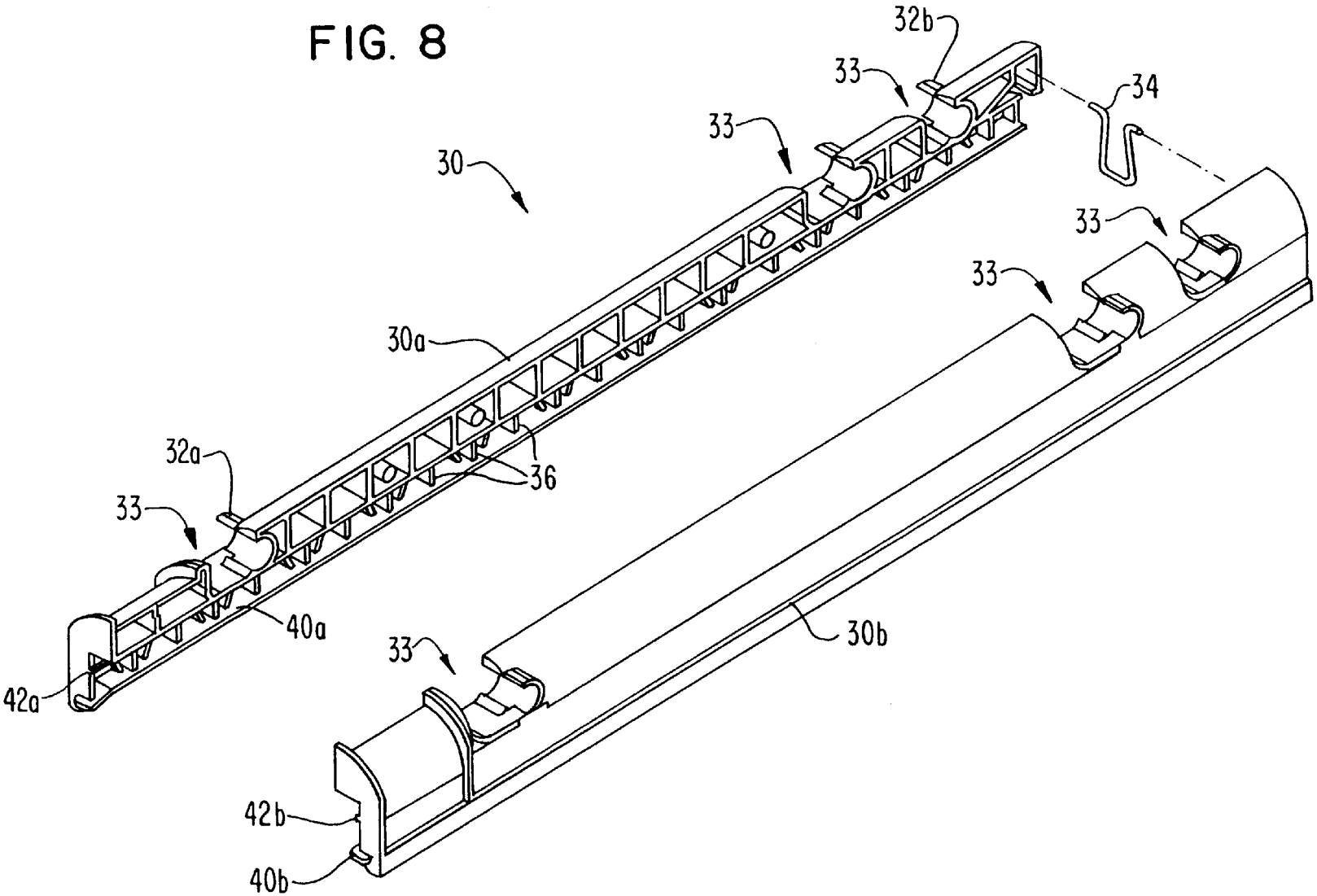
FIG. 8 is an exploded view of a dispensing track according to the invention.
Figure 9:
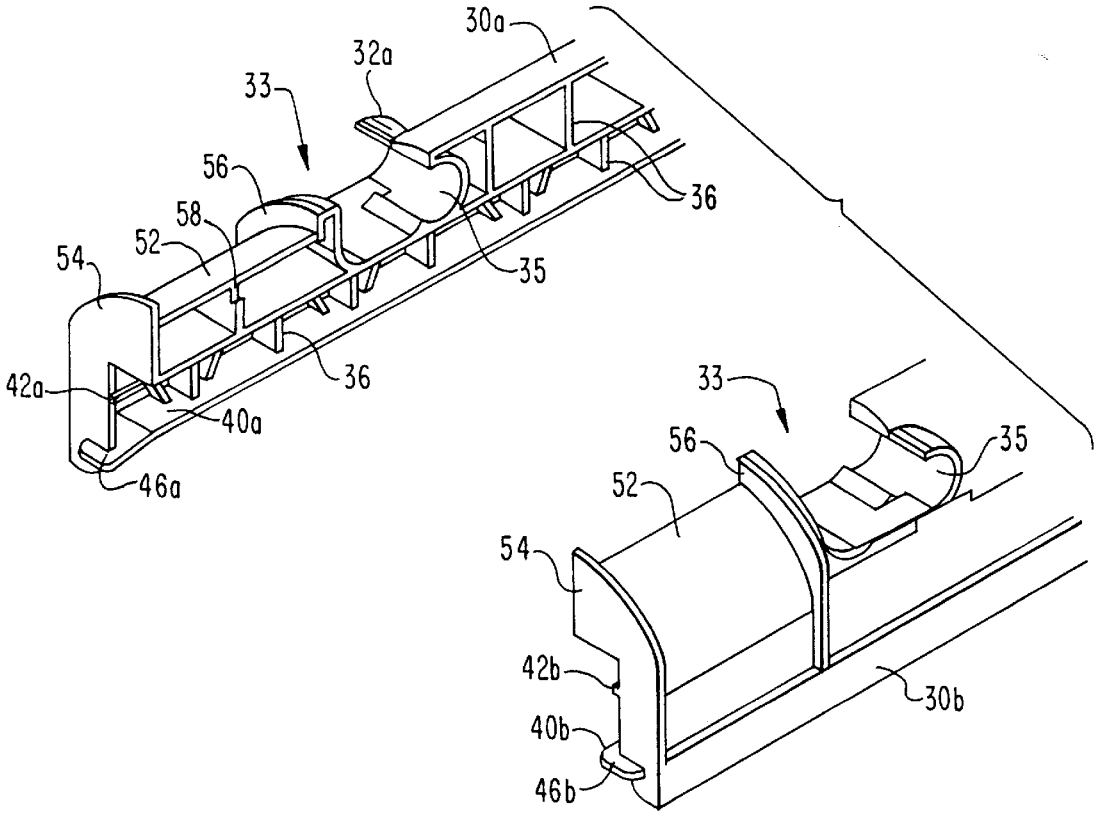
FIG. 9 is an enlarged exploded view of the front end of the track of FIG. 8.
Figure 10:
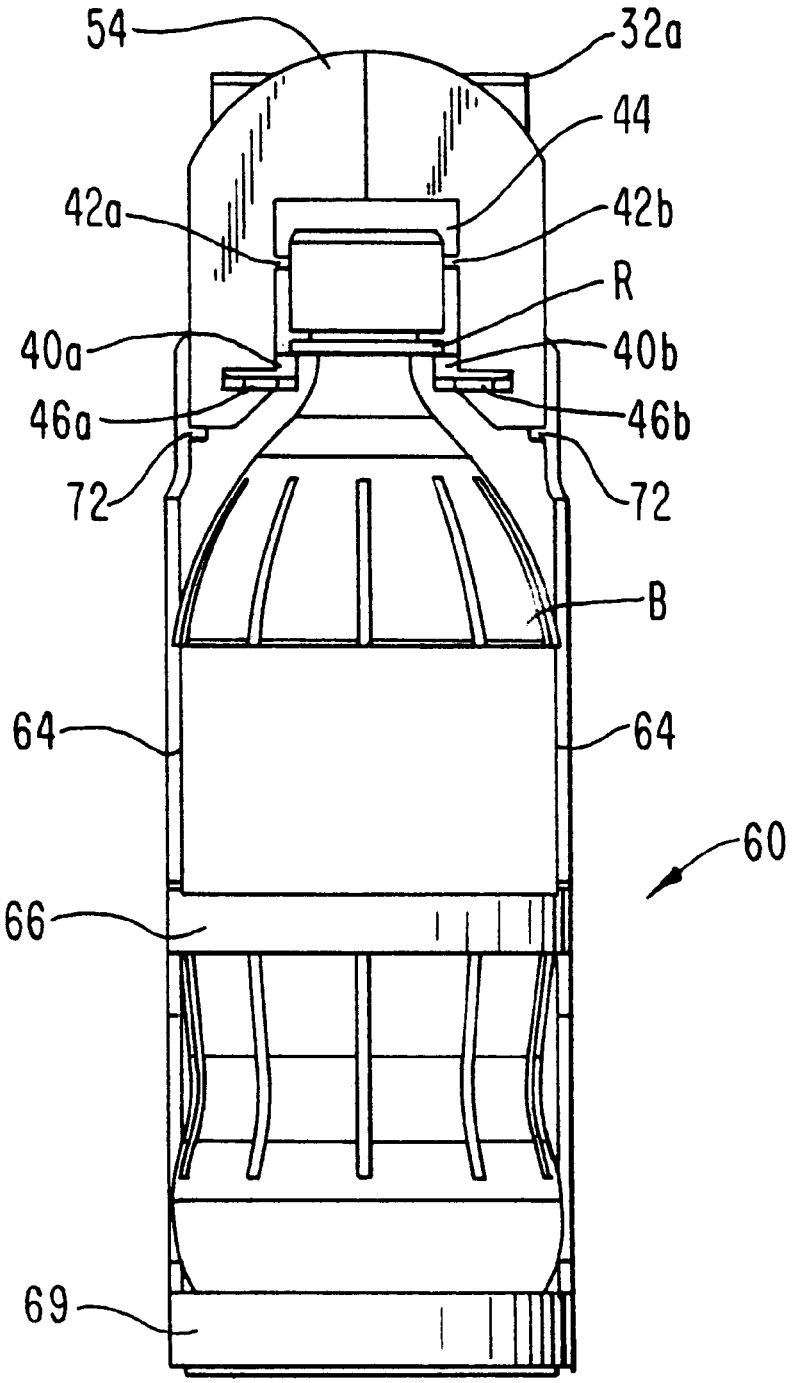
FIG. 10 is a front elevational view of a dispensing track and basket according to the invention, showing a bottle in the basket.

As shown in FIGS. 8, 9 and 10, the lower surface of track 30 includes two lips or rails 40*a*, 40*b* extending inwardly from the opposing sides thereof by a distance of approximately 0.19 inches. Also extending inwardly approximately 0.105 in. from track halves 30*a*, 30*b* are upper ribs 42*a*, 42*b*. Rails 40*a*, 40*b* and ribs 42*a*, 42*b* extend substantially the full length of track 30. For bottles having a 28 mm closure, rails 40*a*, 40*b* and ribs 42*a*, 42*b* define a bottle top channel 44 having a width of approximately 31.24 mm between ribs 42*a*, 42*b*, and a bottom opening between rails 40*a*, 40*b* of 26.95 mm.

The necks of most bottles B having a 28 mm closure include a flange or ring R having a diameter of approximately 32.4 to 33.02 mm, depending on the size of the bottle. Thus, rails 40*a*, 40*b* serve to support bottle B by the neck ring R when the top of the bottle is disposed within channel 44, while ribs 42*a*, 42*b* limit sideways tilting of the bottles to keep the row of bottles substantially aligned. The track of the preferred embodiment of the present invention will support typical 12 oz, 16 oz, 20 oz, 24 oz and one liter bottles, which have a common 28 mm closure. Other sizes of bottles, such as those having a 38 mm closure, could of course be accommodated in the present invention by altering the size of the bottle top channel and the width of the rails 40*a*, 40*b*, and any other support structure as necessary.

The forward ends of rails 40*a*, 40*b* comprise transition ramps 46*a*, 46*b*, respectively, which slant downwardly at an angle of approximately 15° from the rails, and extend forwardly and to the sides of the front opening of the bottle top channel 44. Ramps 46*a*, 46*b* serve to ease the movement of the lead bottle B off rails 40*a*, 40*b*. Referring to FIG. 10, the bottle is supported with its flange or ring R no lower than ramps 46*a*, 46*b*, and preferably at about the same level as the ramps. This arrangement facilitates the bottle's reinsertion into track 30 in the case of a purchaser who has changed his beverage selection and wishes to make room in basket 60 for the bottle that he has just removed. It also allows for speedy loading of bottles into track 30 by beverage delivery personnel.

As noted, track 30 is suspended from crossbars 20 by means of snap hooks 32 which are integrally molded into track halves 30*a*, 30*b*. Referring to FIGS. 8 and 9, each snap hook 32 is formed at the rear of an upwardly open recess 33, and comprises a part-cylindrical socket 35 approximately 0.760 in. in diameter and 240° in extent, with a forward-facing opening approximately 0.656 in. in size. Socket 35 snugly receives crossbar 20 after the crossbar enters recess 33 and track 30 is pushed forwardly to force crossbar 20 past the narrower opening and into the socket. Track 30 thus is suspended at the front by crossbar 20*a* received in snap hook 32*a*, and at the rear by crossbar 20*b* received in one of the rear snap hooks 32*b*.

Figure 3:
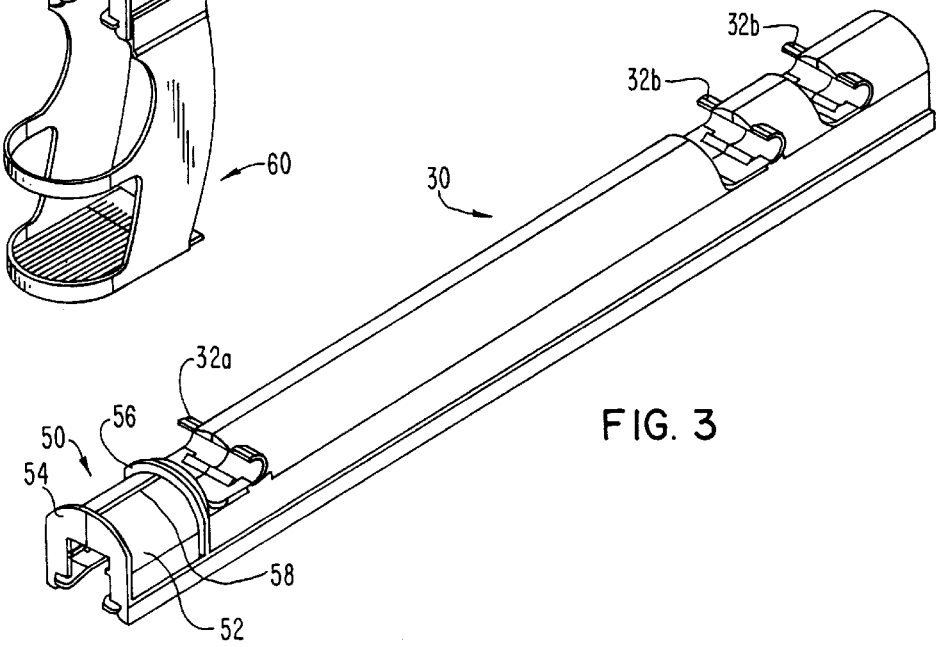
FIG. 3 is a perspective view similar to FIG. 2, showing the track with the basket removed.
Figure 7:
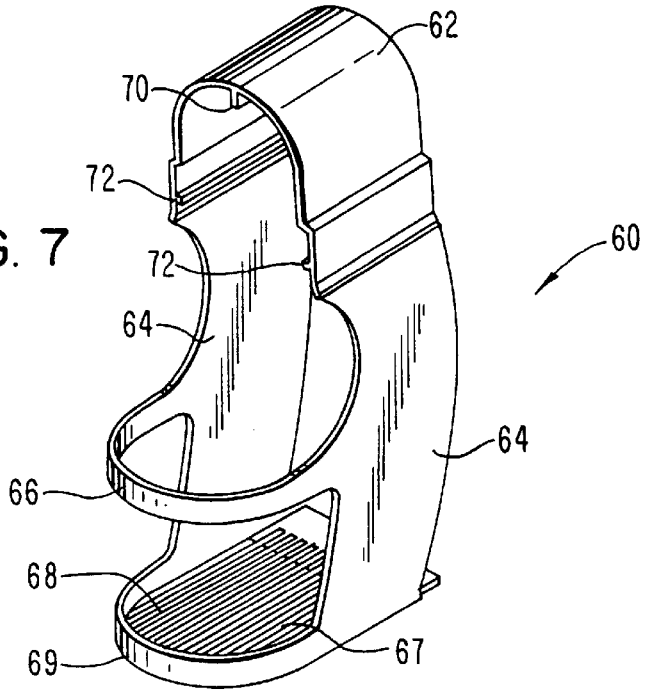
FIG. 7 is a perspective view of another form of dispensing basket according to the invention.

Referring to FIGS. 3 and 9, the front end of track 30 has a basket-carrying or retainer section 50 defined by an arcuate saddle 52, a front flange 54, a rear flange 56 and a central longitudinal slot 58 in saddle 52. Referring to FIGS. 3 and 7, bottle dispensing basket 60 preferably is injection molded of polycarbonate and comprises an arcuate upper hanger portion 62, opposing sidewalls 64 extending downwardly therefrom, a front waist band 66 and a floor structure or platform 68 with a front stop 69 to support the lead bottle B, as shown in FIGS. 1 and 10. Upper hanger portion 62 includes a depending short rib 70 which engages slot 58. Each sidewall 64 has a locking element in the form of a rib 72 which snaps under the edge of track 30 to removably secure basket 60 in the correct position. Thus, basket 60 is removably secured on track 30 for dispensing bottles 20 without the use of additional hardware such as screws, rivets, etc. In addition, there are no moving parts or mechanisms associated with this arrangement that will fail to operate properly due to dirt, dust, or sticky syrup spilling within the display unit. Further, as seen in FIG. 1, basket 60 supports a bottle with little obstruction so that the bottle is highly visible and can easily be grasped and removed by the purchaser. Basket 60 is sized to support a 20 oz. bottle.

Platform 68 of basket 60 preferably includes grooves 67 therein which decrease the surface contact between the bottle and the floor to thereby assist the bottle thereon in maintaining an upright position and provide better seating of the bottle within the forward portion of the basket. Basket 60 may easily be removed or replaced when the size of the bottle to be displayed is changed, e.g., from a 20 oz. bottle to a 1 liter bottle.

Figure 6:
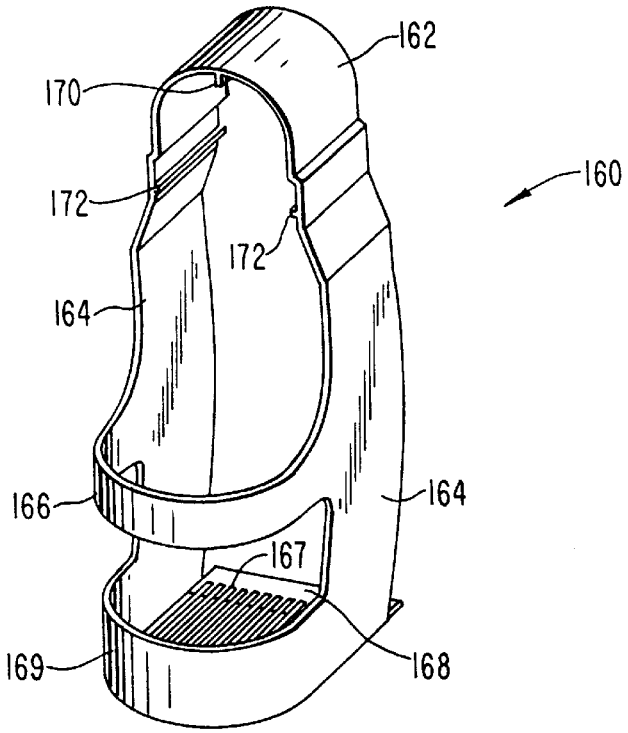
FIG. 6 is a perspective view of one form of dispensing basket according to the invention.

FIG. 6 depicts an alternate basket configuration 160 for accommodating larger bottles, e.g., of the one-liter size. Basket 160 is similar to basket 60, with an arcuate upper hanger portion 162; sidewalls 164; a front waist band 166; a floor structure or platform 168 with ribs 167 and a front stop 169; a short rib 170 for engaging slot 58; and ribs 172 which snap under the edges of track 30.

The invention thus provides a gravity feed system for merchandising bottles for sale. The bottles are suspended within a plurality of tracks 30 that are disposed in a plurality of rows, and the angle of inclination from the rear to the front of the track 30 assures that the bottles will slide forward. The tracks confine the necks and closures of the bottles to keep them aligned, while the basket at the front end of each track presents an upright, highly visible bottle. Thus, the lead bottle does not kick out forward or to the right or left as in the prior art, such that a neater, more organized display is obtained. The purchaser merely grasps the head or shoulders of the bottle and removes the bottle from the basket. If the purchaser changes his beverage selection, he can replace the removed bottle in the basket 60 merely by pushing rearwardly on the bottle occupying the basket so that its flange or ring R rides up ramps 46*a*, 46*b* and onto rails 40*a*, 40*b*. This arrangement also allows for quick and easy loading of bottles into the track from the front by delivery personnel.

From the foregoing detailed description, it will be evident that there are a number of changes, adaptations and modifications of the present invention which come within the province of those persons having ordinary skill in the art to which the aforementioned invention pertains.

What is claimed is:

1. A gravity feed merchandise dispensing device comprising at least one track, each track capable of supporting in tandem a row of similar bottles of the type having an annular flange on the neck of the bottle, each track having a front end, a rear end, a pair of rails spaced apart to receive between them the necks of suitably sized bottles such that the underside of each bottle neck flange engages the rails whereby the bottles are suspended by their flanges for movement relative to the track, and a lead bottle support suspended from the track and sized to support the bottom of the lead bottle of the row with the neck of the lead bottle adjacent the front end of the track but disengaged from the rails, each track normally being inclined downwardly toward the front end so as to permit the suspended bottles to gravity-feed one after the other to the front end of the track each time the lead bottle in the row is unloaded from the lead bottle support, wherein the front end of each of said rails slants downwardly relative to the rail to form a transition ramp for bottle neck flanges as the bottles move from the track to the lead bottle support during dispensing, or as the bottles move from the lead bottle support to the track when the track is being loaded.

2. The dispensing device according to claim 1 wherein the lead bottle support includes a top portion adapted to be supported on a top surface of the track, spaced side members connected to said top portion and adapted to flank the track, and a platform connected to said side members for supporting the lead bottle.

3. The dispensing device according to claim 2 wherein the track has a retainer section adjacent the front end thereof which engages said top portion to retain the lead bottle support on the track.

4. The dispensing device according to claim 3 wherein said retainer section includes a recess in the top of the track which conforms to and receives said top portion.

5. The dispensing device according to claim 4 wherein said recess and said to portion are saddle-shaped.

6. The dispensing device according to claim 5 wherein said recess has a longitudinal medial slot, and said top portion has a depending longitudinal medial rib which mates with said medial slot.

7. The dispensing device according to claim 6 wherein each of said side members is resilient and has a locking element which releasably engages the track to removably secure the lead bottle support in position.

8. The dispensing device according to claim 7 wherein each of said locking elements comprises an inwardly facing rib which snap-actingly engages the adjacent lower side edge of the track when said top portion is received in said recess.

9. The dispensing device according to claim 8 wherein said platform includes a front stop adapted to engage the lower front edge of the lead bottle.

10. The dispensing device according to claim 9 wherein the lead bottle support includes a front waist band above said platform which interconnects said side members at the front of the lead bottle support and is adapted to engage a medial portion of the front of the lead bottle.

11. The dispensing device according to claim 1 wherein said transition ramp slants at an angle of approximately 15 degrees relative to the rail.

12. The dispensing device according to claim 1 wherein said transition ramp extends forwardly of and laterally outwardly along the front face of the track.

13. The dispensing device according to claim 12 wherein the lead bottle is supported with its neck flange above the lowermost edge of said transition ramp.

14. The dispensing device according to claim 1 wherein the lead bottle is supported with its neck flange above the lowermost edge of said transition ramp.

15. A gravity feed merchandise dispensing device comprising at least one track, the track capable of supporting in tandem a row of similar bottles of the type having an annular flange on the neck of the bottle, the track having a front end, a rear end, a pair of rails spaced apart to receive therebetween the necks of suitably sized bottles such that the underside of each bottle neck flange engages the pair of rails whereby the bottles are suspended by their flanges for movement relative to the track, and a lead bottle support suspended from the track and sized to support the bottom of the lead bottle of the row with the neck of the lead bottle adjacent the front end of the track but disengaged from the rails, each track normally being inclined downwardly toward the front end so as to permit the suspended bottles to gravity-feed one after the other to the front end of the track each time the lead bottle in the row is unloaded from the lead bottle support, wherein the lead bottle support is removably suspended on the rack and is interchangeable with at least one other lead bottle support, and wherein the front end of each of the pair of rails slants downwardly relative to the rails to form a transition ramp for bottle neck flanges as the bottles move from the track to the lead bottle support during dispensing, or as the bottles move from the lead bottle support to the track when the track is being loaded.

16. The dispensing device according to claim 15 wherein the at least one other lead bottle support is of a different height to allow the track to accommodate and dispense a row of similar bottles of selected size.

17. The dispensing device according to claim 15 wherein the lead bottle support includes a top portion adapted to be supported on a top surface of the track, spaced side members connected to said top portion and adapted to flank the track, and a platform connected to said side members for supporting the lead bottle.

18. The dispensing device according to claim 15 wherein said transition ramp slants at an angle of approximately 15 degrees relative to the rails.

19. The dispensing device according to claim 15 wherein said transition ramp extends forwardly of and laterally outwardly along the front face of the track.

20. The dispensing device according to claim 17 wherein the lead bottle is supported with its neck flange above the lowermost edge of said transition ramp.

21. The dispensing device according to claim 15 wherein the lead bottle is supported with its neck flange above the lowermost edge of said transition ramp.

22. A gravity feed merchandise dispensing device comprising at least one track, the track capable of supporting in tandem a row of similar bottles of the type having an annular flange on the neck of the bottle, the track having a front end, a rear end, a pair of rails spaced apart to receive therebetween the necks of suitably sized bottles such that the underside of each bottle neck flange engages the pair of rails whereby the bottles are suspended by their flanges for movement relative to the track, and a lead bottle support suspended from the track and sized to support the bottom of the lead bottle of the row with the neck of the lead bottle adjacent the front end of the track but disengaged from the rails, each track normally being inclined downwardly toward the front end so as to permit the suspended bottles to gravity-feed one after the other to the front end of the track each time the lead bottle in the row is unloaded from the lead bottle support, wherein the lead bottle support is removably suspended on the rack and is interchangeable with at least one other lead bottle support, and wherein the track includes two longitudinal halves which are separately injection molded of plastic material and are joined together to form the track.

23. The dispensing device according to claim 22 wherein the at least one other lead bottle support is of a different height to allow the track to accommodate and dispense a row of similar bottles of selected size.

24. The dispensing device according to claim 22 wherein the lead bottle support includes a top portion adapted to be supported on a top surface of the track, spaced side members connected to said top portion and adapted to flank the track, and a platform connected to said side members for supporting the lead bottle.

25. The dispensing device according to claim 22 wherein the front end of each of the pair of rails slants downwardly relative to the rails to form a transition ramp for bottle neck flanges as the bottles move from the track to the lead bottle support during dispensing, or as the bottles move from the lead bottle support to the track when the track is being loaded.

26. The dispensing device according to claim 25 wherein said transition ramp slants at an angle of approximately 15 degrees relative to the rails.

27. The dispensing device according to claim 25 wherein said transition ramp extends forwardly of and laterally outwardly along the front face of the track.

28. The dispensing device according to claim 27 wherein the lead bottle is supported with its neck flange above the lowermost edge of said transition ramp.

29. The dispensing device according to claim 25 wherein the lead bottle is supported with its neck flange above the lowermost edge of said transition ramp.

30. The dispensing device according to claim 22 wherein the two halves of the track are welded together.

31. The dispensing device according to claim 22 wherein the track includes at least one integrally molded hanging element which is adapted to mate with and hang from a transverse bar of a merchandising support rack.

32. A gravity feed merchandise dispensing device comprising at least one track, the t rack capable of supporting in tandem a row of similar bottles of the type having an annular flange on the neck of the bottle, the track having a front end, a rear end, a pair of rails spaced apart to receive therebetween the necks of suitably sized bottles such that the underside of each bottle neck flange engages the pair of rails whereby the bottles are suspended by their flanges for movement relative to the track, and a lead bottle support suspended from the track and sized to support the bottom of the lead bottle of the row with the neck of the lead bottle adjacent the front end of the track but disengaged from the rails, each track normally being inclined downwardly toward the front end so as to permit the suspended bottles to gravity-feed one after the other to the front end of the track each time the lead bottle in the row is unloaded from the lead bottle support, wherein the track includes two longitudinal halves which are separately injection molded of plastic material and are joined together to form the track.

33. The dispensing device according to claim 32 wherein the lead bottle support includes a top portion adapted to be supported on a top surface of the track, spaced side members connected to said top portion and adapted to flank the track, and a platform connected to said side members for supporting the lead bottle.

34. The dispensing device according to claim 32 wherein the front end of each of the pair of rails slants downwardly relative to the rails to form a transition ramp for bottle neck flanges as the bottles move from the track to the lead bottle support during dispensing, or as the bottles move from the lead bottle support to the track when the track is being loaded.

35. The dispensing device according to claim 34 wherein said transition ramp slants at an angle of approximately 15 degrees relative to the rails.

36. The dispensing device according to claim 34 wherein said transition ramp extends forwardly of and laterally outwardly along the front face of the track.

37. The dispensing device according to claim 34 wherein the lead bottle is supported with its neck flange above the lowermost edge of said transition ramp.

38. The dispensing device according to claim 32 wherein the two halves of the track are welded together.

39. The dispensing device according to claim 32 wherein the track includes at least one integrally molded hanging element which is adapted to mate with and hang from a transverse bar of a merchandising support rack.

* * * * *

UNITED STATES PATENT AND TRADEMARK OFFICE

CERTIFICATE OF CORRECTION

PATENT NO. : 6,189,734 B1
DATED : February 20, 2001
INVENTOR(S) : William P. Apps, et al.

It is certified that error appears in the above-identified patent and that said Letters Patent is hereby corrected as shown below:

Column 7,
Line 36, delete "17" and insert -- 19 --.

Column 8,
Line 31, delete "t rack" and insert -- track --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*